US005451941A

United States Patent [19]

Lamazou et al.

[11] Patent Number: 5,451,941

[45] Date of Patent: Sep. 19, 1995

[54] SYSTEM FOR DETECTING THE PASSAGE OF A MOBILE INCLUDING A PASSIVE RESPONDER

[75] Inventors: Bernard Lamazou, Colombes; Franck Francisque, Saint Cyr L'Ecole, both of France

[73] Assignee: Matra Transport, France

[21] Appl. No.: 59,213

[22] Filed: May 10, 1993

[30] Foreign Application Priority Data

May 15, 1992 [FR] France ..... 92 05937

[51] Int. Cl.[6] ..... G08G 1/01

[52] U.S. Cl. ..... 340/933; 340/825.54; 340/572

[58] Field of Search ..... 340/933, 505, 825.54, 340/572, 573, 552, 553, 554, 561, 445, 447

[56] References Cited

U.S. PATENT DOCUMENTS

| | | | |
|---|---|---|---|
| 4,038,653 | 7/1977 | Brewster . | |
| 4,893,118 | 1/1990 | Lewiner et al. | 340/825.34 |
| 4,912,471 | 3/1990 | Tyburski et al. | 340/505 |
| 5,105,190 | 4/1992 | Kip et al. | 340/825.34 |

FOREIGN PATENT DOCUMENTS

| | | |
|---|---|---|
| 2607264 | 5/1988 | France . |
| 2187916 | 9/1987 | United Kingdom . |
| 8803687 | 5/1988 | WIPO . |

*Primary Examiner*—Scott A. Rogers
*Assistant Examiner*—Thomas D. Lee
*Attorney, Agent, or Firm*—Larson and Taylor

[57] ABSTRACT

The system comprises an interrogation assembly and a passive responder. One is carried by a mobile and the other by a track. The interrogation assembly includes continuously operating low frequency and medium frequency transmitters. The transmitters have respective antennas directed towards a predetermined zone with respect to the antennas, which is traversed by the responder during movement of the mobile. It further has a unit which is responsive to the characteristics of the responder when the responder is in the zone. The responder has a low frequency reception circuit which controls a medium frequency circuit. Both circuits have radiating circuits which are tuned and the low frequency signal generated in the low frequency circuit is used to short-circuit the medium frequency tuned circuit of the responder, at the rate of low frequency rate.

10 Claims, 4 Drawing Sheets

SYSTEM FOR DETECTING THE PASSAGE OF A MOBILE INCLUDING A PASSIVE RESPONDER

BACKGROUND OF THE INVENTION

The present invention relates to systems for detecting the passage of a mobile at a predetermined point on its guided displacement along a track, and it has a particularly important, although not limiting, application to automatically controlled public transport installations.

Detection systems are already known of the type that comprises an interrogation assembly and a passive responder, (i.e. having no electrical power supply of its own, neither by means of a battery or storage battery, nor by means of connection to a power supply network), one being carried by the mobile and the other carried by the track, in which:

the interrogation assembly includes firstly a low frequency transmitter and secondly a medium frequency transmitter designed to operate continuously, the transmitters having respective antennas transmitting towards a zone that is predetermined relative to the antennas and through which the responder passes during displacement of the mobile, and secondly a unit that is responsive to the characteristics of the responder when the latter is in the zone, said interrogation assembly being arranged to be connected to an electrical power supply; and the responder comprises a circuit for receiving the medium frequency signal and a circuit for receiving the low frequency signal which is arranged to control the medium frequency circuit.

Among existing systems, particular mention may be made of those in which each responder comprises two members which, when a mobile passes, generate medium frequency signals and which are offset along the track so that the sum of signals received by the interrogation assembly is subjected to a sudden variation as a mobile passes a determined point of the zone.

In general, the passive responder is carried by the track, but it could be carried by the mobile; it is often designated by the term "marker" or "beacon". Since it does not need any electrical power supply and since it is cheap, it is possible to distribute a large number of responders along a track which are single-piece non-reparable units.

SUMMARY OF THE INVENTION

It is an object of the invention to provide a system enabling the cost and complexity of responders to be reduced even further in comparison with existing responders.

To this end, the invention provides, in particular, a system of the hereinbefore defined type wherein said low and medium frequency circuits of the responder comprise respective tuned radiating circuits and are associated in such a manner that the low frequency signal that is induced in the low frequency circuit by the low frequency transmitter of the interrogation assembly short-circuits the medium frequency resonance circuit at the low frequency rate, and wherein said interrogation assembly is responsive to disturbances of the medium frequency transmitter caused by the short-circuiting of the medium frequency tuned radiating circuit of the responder. The responder may easily be implemented so as to be programmable in situ.

In a particularly simple embodiment, the responder may be considered as being analog: The low frequency circuit short-circuits the medium frequency resonant circuit whenever it receives a low frequency magnetic field at a high enough level from the interrogation assembly, at the low frequency rate. The processor unit of the interrogation assembly detects medium frequency resonant circuit short-circuiting (i.e. its active or inhibited state, as the case may be), which changes the characteristics of the medium frequency transmitter due to the magnetic coupling between the medium frequency antenna of the interrogation assembly and the medium frequency tuned circuit of the responder. In practice, the processor unit merely determines whether the transmission medium frequency current is above or below a threshold.

In a more sophisticated embodiment, the responder may be considered as being digital. It further includes a logic unit designed, when enabled, to provide a serial digital message that is modulated at the low frequency rate, and said logic unit short-circuits the medium frequency resonant circuit of the responder only for a predetermined value of a digital message constituted by phase-modulated bits at the low frequency rate, which constitutes a clock signal. The message may differ for each responder. It is reconstructed by processing in the interrogation assembly. The electrical power required for operating the logic unit is generated by rectifying the low frequency signal induced in the low frequency tuned radiating circuit.

In such a responder, that may be referred to as "digital", the digital messages may be sent by phase shift keying ($+\pi/4$, $-\pi/4$), at the rate of the induced low frequency.

The use of a low frequency magnetic field link whose propagation and energy transfer can both be controlled constitutes an intrinsic safety factor as compared with arrangements in which the beacon is responsive to a much more disturbed electro-magnetic field and, at least at high frequency, is subject to parasitic excitation, in particular due to reflections.

The invention will be better understood on reading the following description of particular embodiments, given by way of non-limiting examples. The description refers to the accompanying drawings.

DETAILED DESCRIPTION OF PREFERRED EMBODIMENTS

The embodiments of the invention described below are applicable, in particular, to rail transport installations in which each responder constitutes a marker or beacon that is stationary relative to the track. The system is suitable for use in cooperation with automatic safety systems for driving transport vehicles of the kind already implemented in the VAL system and which therefore require no further description.

The interrogation assembly may be split into two portions; firstly the antennas placed beneath the mobile so as to have an effect on the antennas of the responder, and secondly the electronic circuit assembly that may be offset by a distance of several meters so as to be located in a protected zone. As explained below, the presence of a connecting cable between the antennas and the electronics may be used for the purpose of amplifying the phase offset used for detection purposes.

Figure 1:
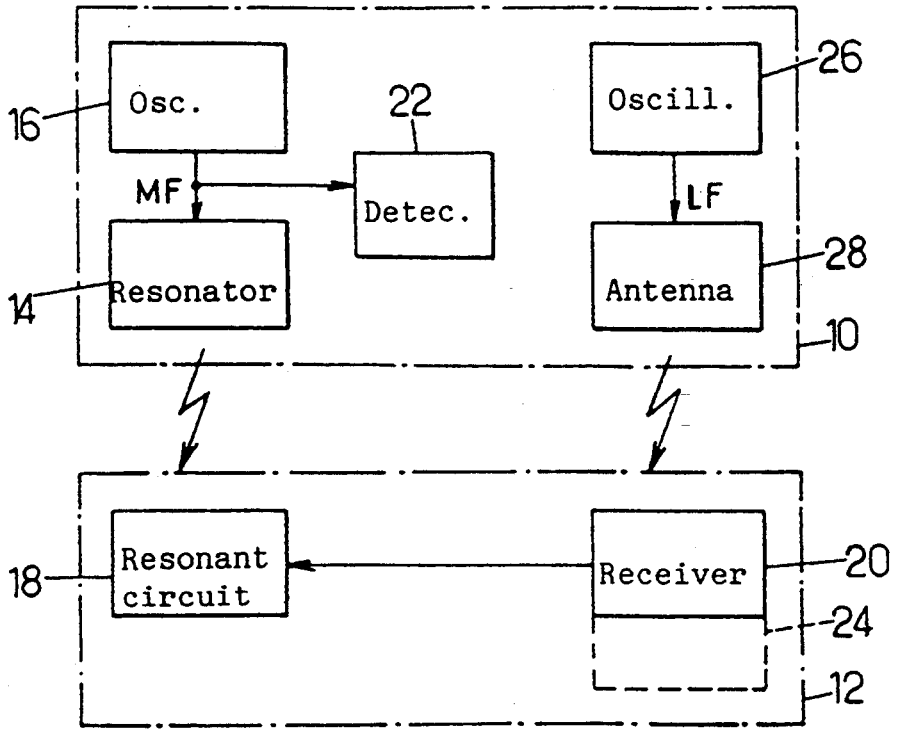
FIG. 1 is a block diagram of the system.

Whatever the embodiment, the detection system has the basic structure shown in FIG. 1. It comprises an interrogation assembly 10 and a responder 12 between which two magnetic field links are established in operation:

a low frequency link, e.g. at 128 kHz, that provides the power required for powering the responder 12 and that sets the modulation frequency of the response (and also the synchronization clock for the return message in the event of a digital responder); and a higher frequency link, generally in the medium frequency band, e.g. in the range 5 MHz to 80 MHz, that can be considered as constituting a return path back to the interrogation assembly.

The principle on which the system operates is then as follows: by continuously analyzing the impedance of an antenna resonator 14 tuned to the medium frequency and connected to a continuously operating medium frequency oscillator 16, it is possible to detect when the medium frequency tuned resonant circuit 18 is short-circuited at the low frequency on receiving the low frequency signal via an LF receiver 20 in the responder.

When the interrogation assembly is located over a responder and the MF resonant circuit 18 is not short-circuited, the antenna resonator 14 becomes de-tuned by magnetic coupling, thereby causing the MF current through the MF resonator 14 to vary. A unit 22 in the interrogation assembly serves to detect this condition by monitoring:

either the phase shift of the MF current relative to a reference that is insensitive to environnement (such as an amplifier output voltage);

or else the amplitude of the antenna current, which varies at the rate at which the resonant circuit 18 is short-circuited, i.e. at the low frequency rate (and also in response to an identification message contained in a read only memory 24 if the responder is a digital responder).

The low frequency link to the LF receiver 20 is provided from the interrogation assembly by means of an LF oscillator 26 that runs continuously in use, and via an LF antenna 28.

A phase or amplitude change due to passing over a responder 12, having its resonant circuit 18 short-circuited at the low frequency rate, is detected, preferably by means of a passive network for amplifying phase or amplitude difference as presented periodically by the MF current delivered by the antenna resonator 14. In particular, the passive network may make use of the properties of unmatched transmission lines that give rise to standing waves. Such a network includes a length of line that is sufficient for even a small amount of unmatching at the end of the line to give rise to a usable effect on the source. The effect appears as a change in the complex impedance as seen from the MF oscillator 16. It gives rise to a voltage/current phase shift or to a change in the amplitude of the current.

In practice, the length of the line will be equal to $(2k+1)\lambda/2$, where k is an integer greater than 1 and $\lambda$ is the wave length of the medium frequency signal.

Figure 2:
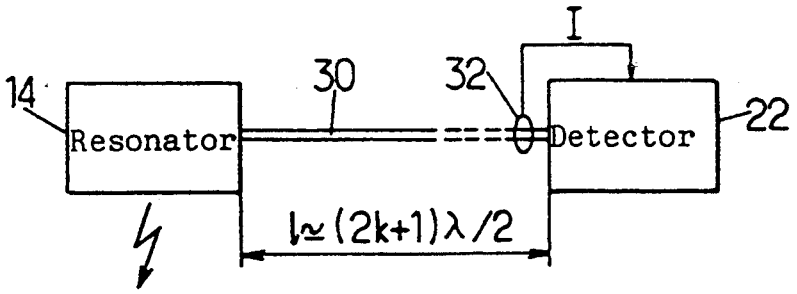
FIG. 2 is a block diagram of a passive network for amplifying phase difference, suitable for use in an interrogation assembly of the system of FIG. 1.

In the embodiment shown in FIG. 2, the line 30 is constituted by a length $\underline{l}$ of cable of known characteristic impedance. The current I in the cable is sensed with a current transformer represented by a loop 32.

Figure 3:
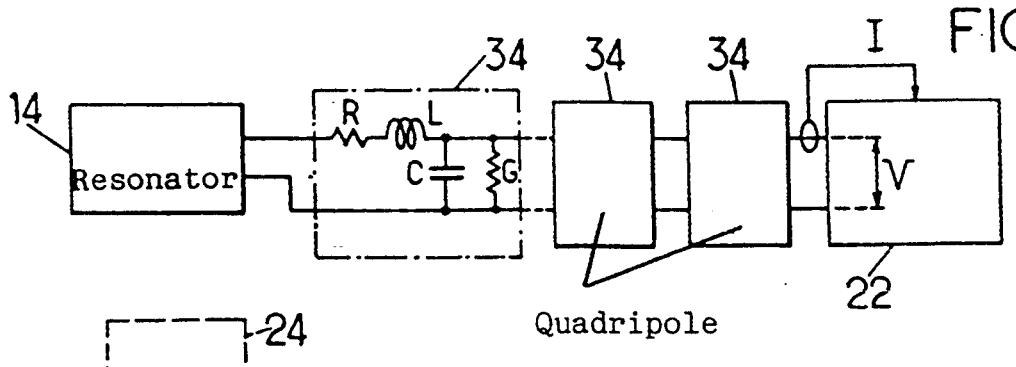
FIG. 3 shows a variant of FIG. 2.

In the example shown in FIG. 3, the line of length $\underline{l}$ is synthetized by a cascade of elementary quadriple cells 34 (R, L, C, G). The number of cells used is sufficient to represent a length of line that is longer than the wave length of the medium frequency signal and that is an odd multiple of a half-wavelength. The current I is again sensed from one of the line conductors and the voltage V is taken across the conductors, at the input of the unit 20, as seen from the antenna. There is no need to describe the LF oscillator 26 which may be of conventional design. The antennas 14 and 28 may both be constituted by flat coils and they may be superposed or even wound on a common insulating support.

The receiver 20 of the responder for short-circuiting the MF resonant circuit 18 is of different structure depending on whether the responder is an analogue responder or a digital responder. In all cases, control may rely on a change in the dynamic impedance of a diode, e.g. constituted by a PN junction, responsive to the current flowing through it. Such dynamic impedance may be considered as being a resistance rd that varies, responsive to the low frequency current Ie flowing through it, in accordance with the relationship:

$$rd=(kT/q)\cdot(1/Ie)$$

where kT/q is the thermo-dynamic potential, of about 25 mV at 20° C.

The medium frequency link must give rise to a current Ie whose extreme values are sufficient when the interrogation assembly passes over the responder, to give rise to a significant change in $\underline{rd}$, enabling the responder to be detected.

The use of the dynamic impedance of a diode as the switching element confers a major advantage from the point of view of intrinsic safety. In this context, it must be recalled that safety requires that there is no excitation of a responder by a mobile or any source other than a mobile travelling over the responder (e.g. to avoid an erroneous indication that a vehicle leaves a block on a railway track). In contrast, failure to detect passage over a responder generally gives rise to consequences that are much less severe, since safety must rather result in failure to detect.

As shown above, the resistance $\underline{rd}$ of the diode is an inverse function of the current flowing through it. Any reduction in the current flowing through the diode below a threshold will give rise to a diode resistance that remains high enough to ensure that there is no finding or short-circuiting. Consequently, the magnetic coupling with the medium frequency resonant circuit 36 is degraded.

Figure 4:
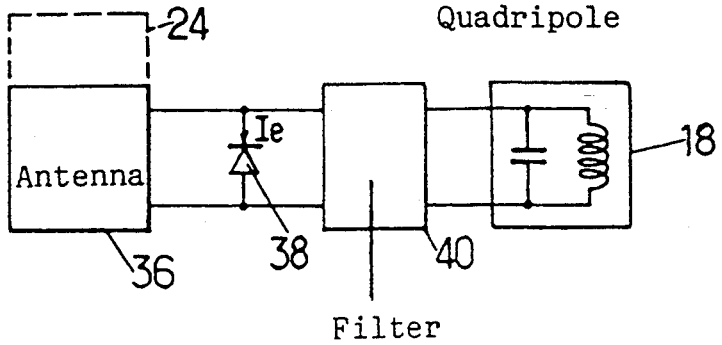
FIG. 4 is a block diagram showing how the medium frequency antenna is short-circuited in the responder of the system of FIG. 1.

If the responder is an analogue responder, the method of control may be as shown diagrammatically in FIG. 4: a diode 38 is connected in parallel across the output of the antenna 36 of the receiver 20. This output is connected to the MF resonator 18 of the responder via a filter 40, for the purpose of eliminating transients and a part of the noise.

If the marker is a digital marker, the receiver also includes a PROM 24 for controlling the current Ie in such a manner as to build up a serial message that may be decoded by unit 22.

Figure 5:
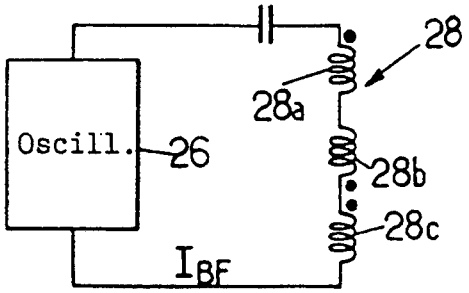
FIG. 5 shows how an LF antenna may be constituted for measuring speed.

An embodiment of the invention that enables the displacement speed of the mobile to be measured under conditions of intrinsic safety, makes use of a low frequency antenna 28 that comprises three components that are offset in the displacement direction and that are powered differently. In practice, the low frequency antenna may then comprise three coils 28*a*, 28*b*, 28*c* that are powered in phase opposition (0, $\pi$, 0) by the LF oscillator 26 (FIG. 5).

As before, the unit 22 can sense changes of current with intrinsic safety by applying envelope detection to the MF current. However, in this case, phase inversions—that occur when the interrogation assembly travels over the responder—are detected at the same times as the instants at which they occur thereby making it possible to calculate speed. With a digital responder, demodulation of the digital signal representative of the identification message must take the phase inversions (0, $\pi$) of the low frequency signal into account.

As explained above, the phase inversions of the low frequency signal can be processed safely by using safety electronics of known type, such as that used in the automatic on-board controllers in the VAL transport system, where the same function is required for detecting passages over the servo-control lines of the transmission mat placed on the crossings of the track.

When necessary, it is also possible to establish a low data rate communication link between the interrogation assembly and the marker. To do this, the low frequency signal can be phase modulated at a low modulation rate of about 1 Kb/s. That modulation may be used as a return channel, which is advantageous in certain responder locations, e.g. in a station. Such a link can be established without requiring an additional antenna on the interrogation assembly.

It is possible to use responders having lengths in the track direction which depend on their locations. It is generally desirable to have short responders in the ordinary portions of the track. In contrast, it may be desirable to use long responders, e.g. having tuned circuits that extend over a length of 1 m to 3 m, in stations. Safety reasons often require vehicle doors to open only when the interrogation assembly of the vehicle is located over a marker. The accuracy with which vehicles are stopped often does not enable this condition to be satisfied if the responders have the short length that is acceptable in an ordinary portion of the track.

Like the responders in an ordinary portion, such responders are compatible with low data rate transmission of a signal via the low frequency channel.

A detection system having a digital responder enabling speed to be measured will now be described as a particular embodiment.

Figure 6:
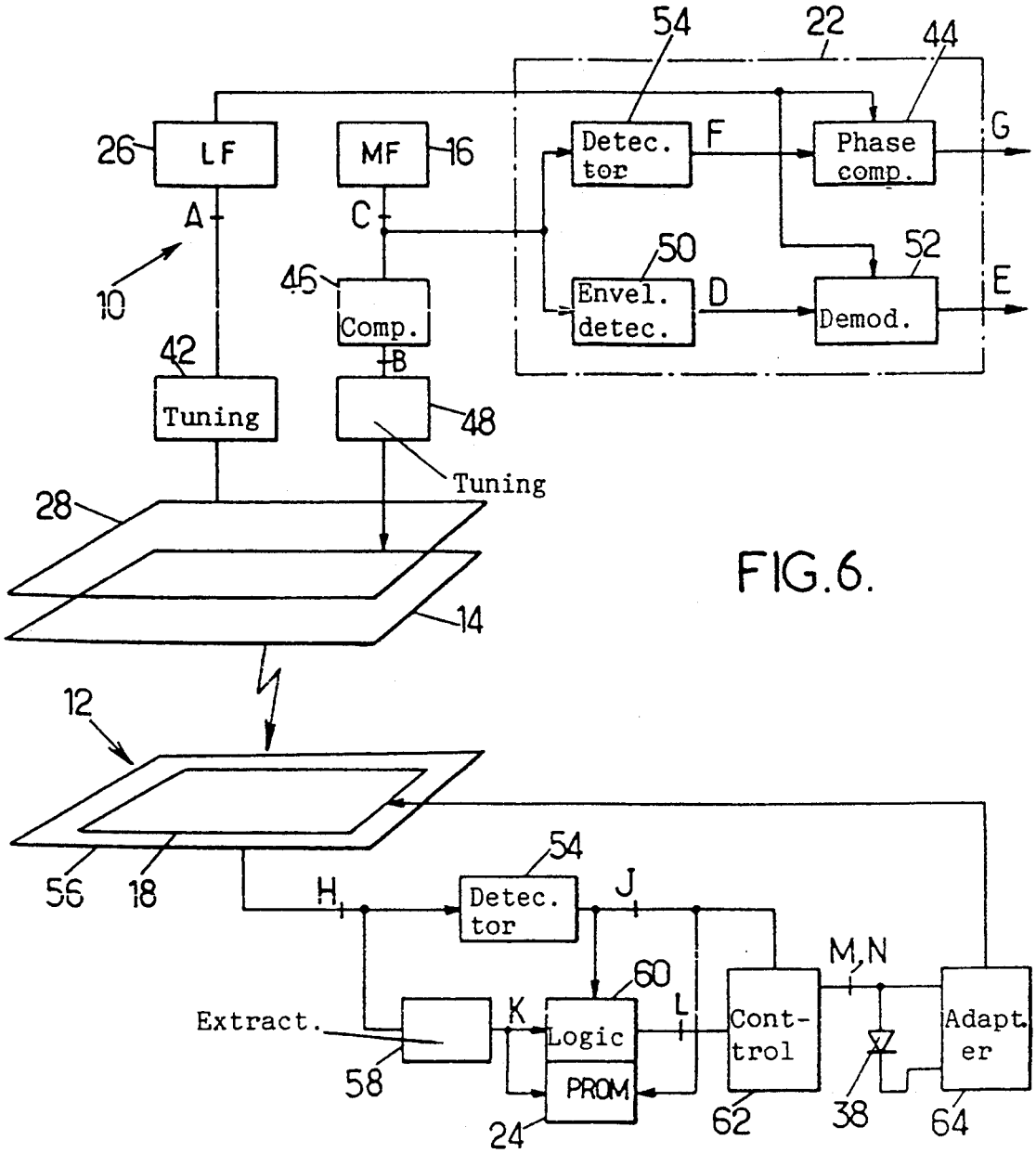
FIG. 6 is a block diagram of a system according to a particular embodiment of the invention, having a digital responder.

The overall structure of this system is shown in FIG. 6 where elements corresponding to elements in the preceding figures are designated by the same reference numerals.

As mentioned above, the interrogation assembly 10 includes an LF oscillator 26 which feeds the LF antenna 28 via a tuning circuit 42. A second output of the LF oscillator 26 feeds a phase demodulator 52 and a safety phase comparator 44 belonging to the processor unit 22 and described below.

The MF transmitter 16 drives the MF antenna 14 via a cable compensation network 46 and a tuning circuit 42. To limit overall size, the antennas may be constructed as concentric flat radiating coils. The Q-factor of the LF antenna must be high enough to ensure coupling that will generate a significant signal in the responder 12. In a railway application, it is possible to use an LF oscillator 26 at 128 kHz, that provides a sine wave signal having a RMS power of 10 W at the LF antenna 20. The tuning circuit may be connected to the electronics by means of a cable having a characteristic impedance close to 50 Ω.

The MF oscillator may deliver an RMS power of about 1 W to the antenna via a cable having a characteristic impedance of 50 Ω at a frequency of 10 MHz. The compensation network 46 is such that the link is of sufficient length for the MF current at the output from the oscillator 16 to be responsive to the de-tuning caused by the presence of the medium frequency resonant circuit of the responder.

The unit 22 shown by way of example retrieves the low frequency component of the MF current modulation at the output from the oscillator 16. The pass band of the unit must be sufficient to avoid distorting the digital message provided by the programmable read only memory 24 of the marker. For a low frequency of 128 kHz, an acceptable pass band is about 300 kHz.

The unit 22 includes a functional path that is necessary and a safety path that is merely optional. The functional path comprises an envelope detector 50 for recovering the LF signal and a phase demodulator 52 for recovering the PSK coded digital message. The detector 50 may include a diode rectifier in conventional manner.

The safety envelope detector 54 of the safety path operates on the same principle as the detector 50, with a narrower pass band. The safety path does not need to recover a message, it merely has to identify the 128 kHz spectral peak and phase inversions on passing from coil 28*a* to coil 28*b*, and from coil 28*b* to coil 28*c*. The circuit shown in FIG. 6 further makes it possible to perform safety speed measurements. The function of the detector 54 is to recover the low frequency transmitted by the interrogation assembly and to enable the signal phase (0, $\pi$), to be recognized, which phase depends on which one of the coils (FIG. 5) is beneath the LF antenna 28. The safety phase comparator 44 determines phase rotations (0, $\pi$) in the low frequency signal and may be constructed to be secure, as is the case for the circuits used in the VAL systems.

Also advantageously, the responder 12 includes antennas constituted by concentric coils, the MF resonant circuit having a Q-factor that is high enough for the magnetic coupling effect with the antenna resonator 14 to generate a detectable disturbance.

The resonator also includes a rectifier network 54 which provides the necessary power supplies from the low frequency power induced in the antenna 56 of the low frequency receiver 20. A second circuit 58 extracts a clock signal from the low frequency signal. The rectified signal is applied to a logic unit 60 connected to the read only memory 24. The logic unit also includes a phase modulator for PSK encoding of the digital signal from the read only memory at the low frequency rate provided by the clock circuit 58.

The MF resonant circuit 18 is short-circuited by a diode 38 that is current driven from a control circuit 62, whose switching element may be a bipolar transistor. A network 64 matches the impedance of the control circuit to that of the MF resonant circuit 18.

Figure 7:
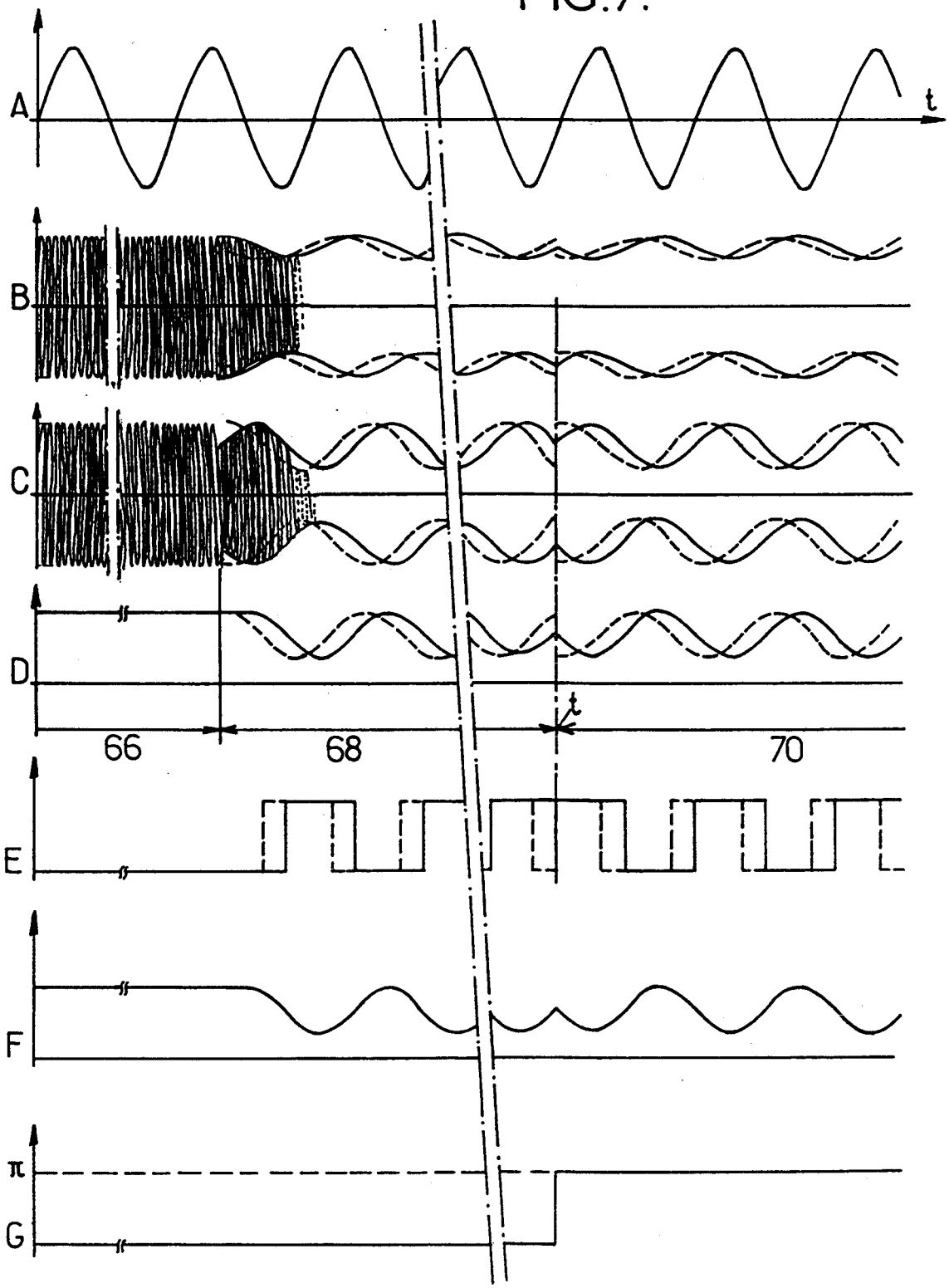
FIG. 7 and 8 are wave-form diagrams showing the appearance of the signals that appear in the interrogation assembly and in the responder, respectively.

By way of example, FIG. 7 shows the appearance of signals in the interrogation assembly at points marked in FIG. 6 by letters that correspond to the lines of FIG. 7. Time interval 66 corresponds to operation during the period when the interrogator is not moving over a responder. Time interval 68 corresponds to the first coil of an antenna of the kind shown in FIG. 5 passing over the responder. Time t corresponds to a phase inversion that occurs when the second coil is coupled with the responder. At the end of the second stage 70, a third stage occurs (not shown) during which the phase is the same as it was during the first stage.

Figure 8:
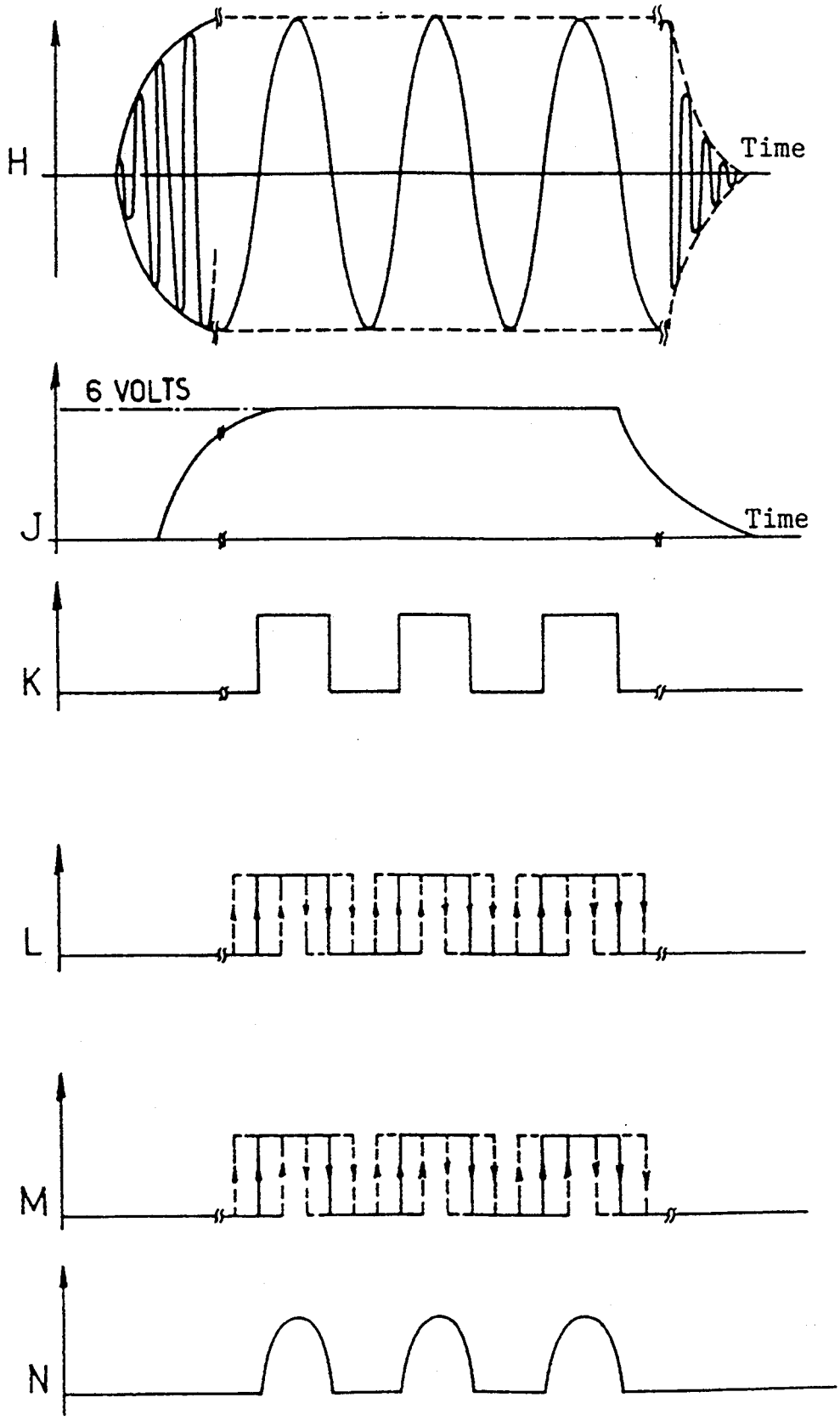

FIG. 8 shows the appearance of signals in the responder 12 at points marked by letters in FIG. 6, for a digital marker (ligne M) and for an analog marker (line N).

The signal K is generated only in a digital responder. In a digital responder, the signal M corresponds to the MF resonant circuit 18 being opened and short-circuited. In an analog responder, the resonant circuit is opened and closed merely at the rate of the low frequency. Due to rectification, the signal J gives rise to a magnifying effect.

We claim:

1. A system for detecting the passage of a mobile at a predetermined point during a guided displacement thereof along a track, comprising an interrogation assembly and a passive responder, one of which is carried by the mobile and the other of which is carried by the track, wherein the interrogation assembly includes:

a low frequency transmitter and a medium frequency transmitter both designed to operate continuously, said transmitters having respective antennas arranged to transmit towards a zone having a predetermined location relative to the respective antennas which is selected for the responder to pass through it during displacement of the mobile, and a unit responsive to the characteristics of the responder when the latter is in said zone, said interrogation assembly being connectable to an electrical power supply; wherein the responder comprises a circuit for receiving a medium frequency signal from said medium frequency transmitter and a circuit for receiving a low frequency signal from said low frequency transmitter, arranged to control the medium frequency circuit, said low frequency circuit and said medium frequency circuit comprising respective tuned radiating circuits and being operatively associated in such a manner that said low frequency signal, when induced in the low frequency circuit by the low frequency transmitter of the interrogation assembly short-circuits the medium frequency circuit at the low frequency, and wherein said interrogation assembly is arranged to be responsive to disturbances of the medium frequency transmitter caused by the short-circuiting of the medium frequency tuned radiating circuit of the responder.

2. System according to claim 1, wherein the circuit for receiving the low frequency signal is so connected to the medium frequency tuned circuit as to short-circuit the latter at the low frequency as long as it is subjected to a low frequency magnetic field generated by the respective antenna having a level higher than a predetermined threshold.

3. System according to claim 1, wherein said responder further includes a logic unit designed, when enabled, to deliver a serial digital message modulated at the low frequency, and said logic unit short-circuits the medium frequency resonant circuit of the responder only for a predetermined value of a digital message constituted by bits which are phase-modulated at the low frequency which constitute a clock signal.

4. System according to claim 3, wherein said serial digital message is $(+\pi/4-\pi/4)$ PSK encoded.

5. System according to claim 1, wherein the antenna of said low frequency transmitter has a plurality of coils distributed along said track, two successive ones of said coils being fed by said low frequency transmitter with a 180° phase shift.

6. System according to claim 1, having means for low rate PSK encoding of the output signal of said low frequency transmitter.

7. System according to claim 1, wherein said unit of said interrogation assembly comprises a passive network for amplifying a phase shift of a current at the medium frequency, said passive network comprising a line having a length higher than the wave length of the medium frequency signal and equal to an odd multiple of half the wave length.

8. System according to claim 7, wherein said line is synthetized by a cascade of cells.

9. System according to claim 1, wherein said unit of said interrogation assembly comprises a functional channel and a safety channel, said functional channel having an envelope detector and a phase demodulator while the safety channel comprises an envelope detector and a phase comparator, the envelope detector of the safety channel having a pass band which is narrower as compared with the envelope detector of the functional channel.

10. System according to claim 1, wherein the low frequency tuned circuit of said responder is arranged to drive a current in a diode which is in parallel with said medium frequency tuned circuit, whereby achieving safety of the short-circuiting of the medium frequency tuned circuit due to the intrinsic safety provided by said diode.

* * * * *